United States Patent [19]

Haberhauer et al.

[11] Patent Number: 4,481,903

[45] Date of Patent: Nov. 13, 1984

[54] APPARATUS FOR DEVELOPING AN ELECTROSTATIC LATENT IMAGE ON A RECORDING MEDIUM

[75] Inventors: Helmuth Haberhauer, Taunusstein; Gerhard Spingath, Wiesbaden, both of Fed. Rep. of Germany

[73] Assignee: Hoechst Aktiengesellschaft, Frankfurt am Main, Fed. Rep. of Germany

[21] Appl. No.: 462,384

[22] Filed: Jan. 31, 1983

[30] Foreign Application Priority Data

Feb. 19, 1982 [DE] Fed. Rep. of Germany ..... 3205989

[51] Int. Cl.[3] ..... G03G 15/08

[52] U.S. Cl. ..... 118/653; 118/657; 118/658; 355/3 CH; 355/3 DD

[58] Field of Search ..... 355/3 DD, 3 CH; 118/653, 657, 658

[56] References Cited

U.S. PATENT DOCUMENTS

| | | | |
|---|---|---|---|
| 3,638,613 | 2/1972 | Klavsons et al. | 118/637 |
| 3,918,402 | 11/1975 | Ohta | 118/637 |
| 4,286,543 | 9/1981 | Ohnuma et al. | 118/657 |
| 4,395,110 | 7/1983 | Hosono et al. | 355/3 DD |
| 4,410,259 | 10/1983 | Yamagata et al. | 355/3 DD |

FOREIGN PATENT DOCUMENTS

| | | |
|---|---|---|
| 2345827 | 4/1974 | Fed. Rep. of Germany . |
| 3107055 | 1/1982 | Fed. Rep. of Germany . |
| 2002655 | 2/1979 | United Kingdom . |
| 2095132 | 9/1982 | United Kingdom . |

*Primary Examiner*—Evan K. Lawrence

*Attorney, Agent, or Firm*—Schwartz, Jeffery, Schwaab, Mack, Blumenthal & Koch

[57] ABSTRACT

The invention relates to a developing apparatus which, in a preferred embodiment, includes a first charging device comprising a rotating device, preferably designed as a brush having a core which is connected to a first voltage source. A single component developer is fed, from a developer feed unit, to the first charging device, by means of a metering roller. The charging device is enclosed by a trough, which is connected to a voltage source. A scraper in glancing contact with the bristles of the first charging device imparts an additional charge to the developer by tribo-electricity and sprays particles of developer on the bristles onto a developing roller. A second charging device, in the form of a second brush having a core connected to said voltage source may also be used. The grid is then positioned between the charging devices. A second scraper functions, in a similar manner, in conjunction with the second charging device. The developing roller is connected to a second voltage source and particles of developer, which form a uniform layer on the peripheral surface of the developing roller, are attracted by a latent charge image on a recording medium, to thereby obtain a developed charge image.

12 Claims, 4 Drawing Figures

APPARATUS FOR DEVELOPING AN ELECTROSTATIC LATENT IMAGE ON A RECORDING MEDIUM

BACKGROUND OF THE INVENTION

1. Field of the Invention

The present invention relates to an apparatus for developing an electrostatic latent image which has been generated on a recording medium. More particularly, the present invention relates to an apparatus employing an electrically charged single component developer which is conveyed, by a developing roller, onto the surface of the recording medium.

2. Background and Prior Art

An apparatus of the above type is known from U.S. Pat. No. 4,286,543 to Ohnuma et al which describes an apparatus in which a device for applying a developer is brought into pressure contact with a recording medium at a defined pressure. The device has an endless, conducting surface which yields resiliently, and the latent charge image on the recording medium is developed by a single component developer. The device for applying the developer and the recording medium are moved in the same direction. The peripheral speed of the device for applying the developer is somewhat greater than that of the recording medium. The apparatus employed for the process possesses a blade electrode, which bears against the surface of the device at a defined pressure for applying the developer, and which charges the single component developer with a predetermined polarity by charge injection.

The ratio of the peripheral speed of the device for applying the developer to that of the recording medium lies within the range from 1.1:1 to 1.5:1.

The most commonly used developing processes employ two-component developers, which are composed of toner and carrier particles. Recently, single component developers have been employed. These developers generally involve magnetic single component toners. When a two-component developer is used, it is necessary to measure the toner consumption continously inasmuch as the toner is constantly being carried out by the copies, and to effect a metered replenishment of the toner in a manner which ensures that the ratio of toner to carrier particles remains substantially constant. Since, in the case of a two-component developer, the carrier particles are not consumed, their long residence time in the developing system of the copier causes them to be subject to an aging process, for example as a result of corrosion, which leads in turn to precipitation of the toner by the carrier particles. This results in undesirably large quantities of toner precipitating onto the background of the copy. In the case of the two-component developers, it is also disadvantageous to have a large amount of developer continuously present in the developing system inasmuch as long residence times of the toner in the developer will result in the quantity of the former being reduced by comminution processes and the process whereby the aging of the developer as a whole is accelerated.

Magnetic single component developers do not exhibit the above-mentioned disadvantages but require expensive and sometimes complicated magnetic components, such as for example magnetic brushes, in order to transport them. Even in the case of magnetic single component developers, a certain difficulty results from the fact that, due to their magnetic constituents, they possess a higher electrical conductivity. As a result, the process of charging the magnetic toner, by tribo-electricity, is rendered more difficult.

A developing apparatus for a single component developer is known from German Offenlegungsschrift No. 3,107,055. That document describes an apparatus in which a thin, uniform layer of an insulating, non-magnetic, single component developer is formed on a developer carrier, and a latent image carrier is positioned opposite the developer carrier in order to develop a latent image which has been generated on the latent image carrier. A coating device is provided for applying the developer to the developer carrier, in a defined layer thickness. The coating device may comprise, for example, a grid and a pressure element for pressing the grid against the developer carrier.

A developing apparatus for a two-component developer is known from German Offenlegungsschrift No. 2,345,827. The apparatus described in this reference comprises a magnetic brush with a roller brush bearing against its periphery. The roller brush scatters the developer from the surface of the magnetic brush, and wires are provided for removing the developer from the bristles of the roller brush. The cloud of developer created as a result of this scattering process moves towards a photoconductive drum carrying the latent image which is to be developed. A wire mesh is located at a short distance from the surface of the photoconductive drum. The wire mesh is configured as a counter electrode to the photoconductive surface, and is intended to prevent insufficiently charged toner particles from reaching the recording medium. However, the particles which are held back cause meshes of this type to become clogged.

In devices for applying single component developer which comprise blade electrodes for limiting the layer thickness, or which comprise a pressure element, with a grid, bearing against a developing roller, the developer can undergo an agglomeration and compaction process, which takes place under pressure. As a result, the desired formation of a uniformly thick and uniformly charged layer of toner may be prevented.

SUMMARY OF THE INVENTION

An object of the present invention is to provide an improved apparatus for developing an electrostatic latent image which has been generated on a recording medium.

A further object of the invention is to provide an apparatus which can avoid caking of the particles of a single component developer and enable the thickness of a layer of the single component developer to form uniformly on a developing roller.

It is a still further object of the present invention to provide an apparatus for forming a uniform layer of a single component developer of a developing roller without layer limiting devices, such as doctor blades, grids, or similar elements, and which is operable to charge the single component developer, uniformly and adequately, as it travels towards the developing roller.

The apparatus according to the present invention develops an electrostatic latent image which has been generated on a recording medium and may utilize an electrically charged single component developer and comprise a developing roller located a short distance from the recording medium, and a developer feed unit for the single component developer. The single component developer is preferably fed by the developer feed unit to a surface of one of at least two charging devices, where the surface of the two charging devices are separated by a distance which is smaller than any of the distances between the charging devices and the developing roller, and where a scraper device for imparting additional charge to the developer is associated with each charging device and is in glancing contact with the surface of the charging device.

Preferably, the charging devices are designed as brushes, which are made of an electrically conducting material, a cylindrical core of each charging device being connected to the same pole of a voltage source, the other pole of which is grounded.

Alternatively, the charging devices may include brushes which are electrically insulated, but which can be electrostatically charged. Electrically conducting brushes may be preferable when increasing the controllability of the charging process is desired, and also to prevent the charge from exceeding a defined magnitude.

With the present invention, charging of the single component developer is effected by means of charging devices of simple construction, preferably in the form of brushes whose potential and, therefore charging of the single component developer, is easily controlled. This permits the layer of developer on the developing roller to be regulated, without requiring layer limiting doctor blades, by means of the speeds at which the brushes and the developing roller rotate. Furthermore, in order to replenish the developer which has been carried out of the developing apparatus by each image development, only small quantities of developer need to be fed in, which are preferably rapidly, effectively and uniformly charged to the desired voltage by tribo-electric charging, thereby maintaining the total charge on the developer present in the developing apparatus at a preset value.

Additional objects, advantages and novel features will be set forth in the description which follows, and in part will become apparent to those skilled in the art upon examination of the following.

BRIEF DESCRIPTION OF THE DRAWINGS

The accompanying drawings, which are incorporated in and which form a part of the specification, illustrate several embodiments of the present invention and, together with the description, serve to explain the principles of the invention. In the drawings.

DETAILED DESCRIPTION OF THE INVENTION

Figure 1:
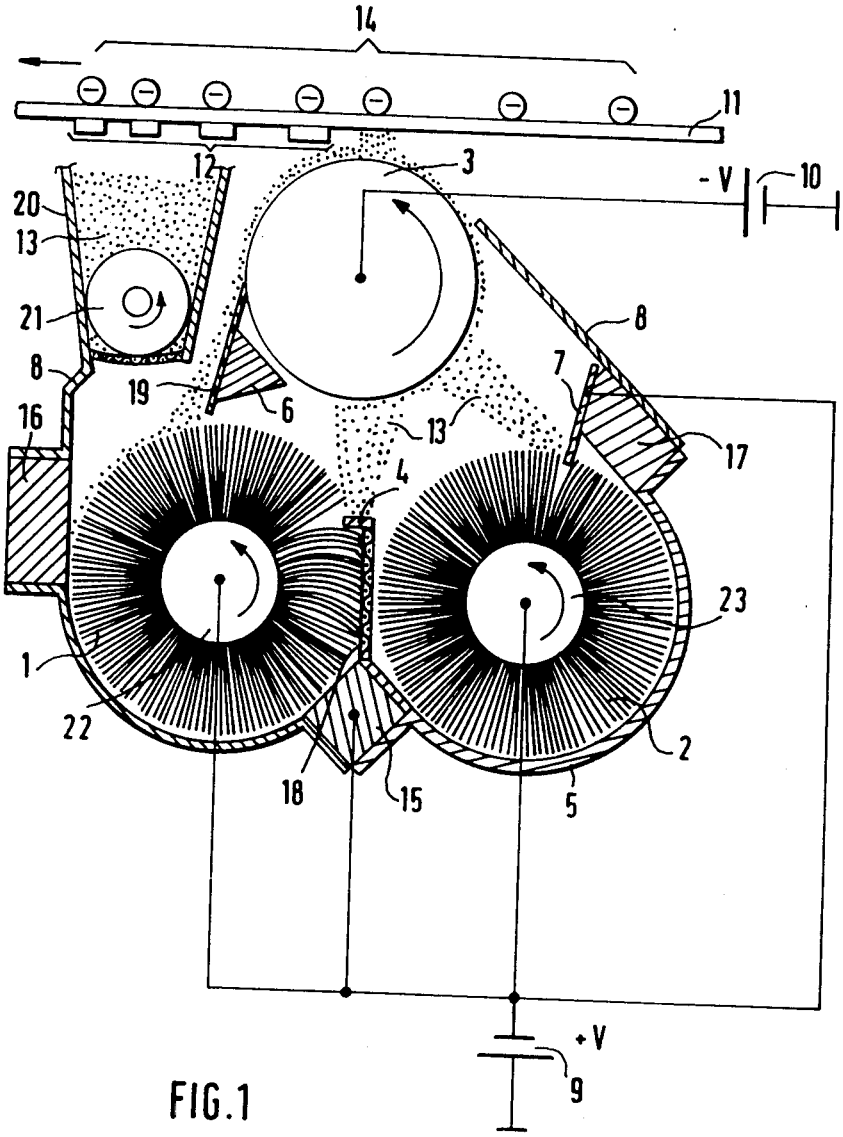
FIG. 1 illustrates a diagrammatic view of a developing apparatus according to the invention.

Reference will now be made in detail to the present preferred embodiment of the invention, examples of which are illustrated in the accompanying drawings. Turning first to FIG. 1, there is diagrammatically depicted a developing apparatus comprising two charging devices 1 and 2, which are designed as brushes with cylindrical cores 22 and 23 respectively. The material of the brushes is preferably electrically conductive. For example, steel wire brushes or the like may be used, made, for example, from abrasion resistant materials, such as CrNi steels. The peripheral surfaces of the charging devices 1 and 2 are separated, preferably by a distance which is smaller than the distances between either of the individual charging devices and a developing roller 3. The two charging devices 1 and 2 are enclosed by a trough 5, which is shaped so that it matches the cylindrical peripheral surfaces of the charging devices 1 and 2 and is preferably composed of the same material as the charging devices. The distance between the inner surface of the trough 5 and the peripheral surfaces of the charging devices 1 and 2 lies within the order of magnitude of 0.2 to 1 mm. In the case where the charging devices are brushes, the distance between the inner surfaces of the trough 5 and tips of the bristles of these brushes lies within the order of magnitude of 0.2 to 1 mm. The distance is selected so that no contact occurs between the trough and the brushes, in order to prevent abrasion. As a result of the small volume between the trough 5 and the charging devices 1 and 2, only small quantities of developer 13 are required to effect satisfactory charging of the toner. The developer 13 is a single component developer which may be replenished in a metered manner, such as by means of a metering roller 21, near the outlet of the developer feed unit 20, into which a stock of developer 13 is poured. Both charging devices 1 and 2 rotate, for example, counter-clockwise, so that the developer metered from the feed unit 20 is evenly distributed. The quantity of developer 13 which must be metered to replenish the developer consumed by the image development process, for an average blackening density of the copy, amounts to approximately 50 to 100 mg, which is approximately 1 percent of the quantity of developer which is being circulated. This quantity of developer can be charged rapidly and effectively, both by an applied potential and by tribo-electric charging as will be described in greater detail below, so that the uncharged single component developer which is newly fed, does not cause the charge on the single component developer 13 to fall. The total electrical charge on the single component developer which is present in the developing apparatus is accordingly kept substantially constant during operation.

The cylindrical cores 22 and 23 of the two charging devices 1 and 2 are connected to the same pole of a voltage source 9, the other pole of which is grounded. If, for example, a positively charged single component developer 13 is used, a voltage in the range of approximately +500 to +800 volt, and more particularly about +600 volt, may be applied to the two charging devices 1 and 2. This polarity is the same as that of the developer. In order to impart an additional charge to the toner, a grid 18 is located between the charging devices 1 and 2. This grid is connected to the trough 5. A scraper 4 is integrally joined to the grid 18 and is in contact with the bristles of the charging device 1. The material of the grid is preferably metal, but it can also be manufactured from plastic. Single component developer 13 is conveyed from the charging device 1, through the grid 18, to the charging device 2. While passing through the grid, the single component developer 13 experiences additional tribo-electric charging, the magnitude of which depends on the particular grid material used. Those particles of developer which are not conveyed through the grid 18 remain stored on the bristles of the steel wire brushes of the charging devices 1 and 2. In the case of the first charging device, the particles enter the vicinity of the scraper 4, which projects into the peripheral path, or movement path, of the charging device 1 a distance whereby it momentarily restrains the tips of the individual bristles, which are then released as the charging device 1 continues to turn, by a snapping movement over and past the scraper 4. This snapping movement causes the developer particles stored between the bristles to be thrown upwards, the individual particles being, for example, positively charged. This charge is imparted to the particles by the charging device 1 in consequence of the voltage of, for example about +600 volt which is applied to it, and of a tribo-electric charge, which occurs as a result of the rapid separation of the developer particles from the bristles during the scraping operation by the scraper 4.

A scraper 7 likewise projects into the movement path, or peripheral path, of the second charging device 2. This scraper momentarily restrains the individual bristles of the steel wire brush until the energy stored in the bristles, as a result of elastic deformation, is sufficient for the bristle to snap over and past the scraper 7. In the course of this snapping movement, the developer particles stored between the individual bristles are thrown towards the developing roller 3 and are charged both by the voltage of, for example, +600 volt, which is applied to the second charging device 2, and by the tribo-electric charging process which occurs during the rapid separation of the developer particles from the individual bristles.

As has already been mentioned, the same voltage potential is preferably applied to the two charging devices 1 and 2. However, it is obvious that different voltage levels can be applied to the two charging devices if they are installed in the apparatus in a manner whereby they are electrically insulated from one another.

The trough 5 preferably comprises two semicylindrical portions, which are fastened to a bearer 15. The bearer 15 is composed of an electrically conducting material, or of an insulating material. In the first case, the bearer 15 is connected to the same pole of the voltage source 9 as the cylindrical cores 22 and 23 of the two charging devices 1 and 2. If the bearer 15 is composed of an insulating material, the trough 5 is connected directly to the corresponding pole of the voltage source 9. The scraper 7 is likewise connected to the pole of the voltage source 9, to which the cylindrical cores 22, 23 are connected. The two edges of the trough 5 are fastened to side bearers 16, 17, which are preferably composed of an insulating material. In addition, an upper member 8 is fastened to the side bearers 16 and 17 to close the developing apparatus in the upward direction. The side surfaces of the upper part 8 runs generally obliquely upwards towards the developing roller 3.

A further voltage source 10 is connected to the developing roller 3 and the voltage applied lies, for example, within the range from −200 to −300 volt, and in any event is preferably of an opposite polarity to that imposed on the charging devices 1 and 2. With the above-described apparatus, a uniformly thick layer of developer forms on the peripheral surface of the developing roller 3, this layer being selectable within a range of from about 30 to 150 μm. The development is typically effected in an inverted position, and the recording medium 11, which preferably comprises a continuously circulating photoconductive strip with a latent charge image 14, is led past the developing roller 3, at a distance which is slightly greater than the selected layer thickness. The recording medium 11 is, for example, negatively charged, to a voltage of between approximately −500 to −1000 volt, and more particularly to about −600 volt. In FIG. 1 the latent charge image 14 is suggested, diagrammatically, by small circles enclosing a minus sign. In operation, the positively charged developer 13 will not be held back, relative to the latent charge image 14, by the negatively charged developing roller 3, since the absolute value of the negative voltage at the developing roller 3 is smaller than the absolute value of the negatively charged photoconductor. Consequently, the developer 13 develops the latent charge image 14 to produce a powder image 12.

The speeds at which the charging devices 1 and 2 rotate typically lies within the range of from about 100 to 200 revolutions per minute, while the developing roller 3 rotates at a speed of about in the range of 50 to 80 revolutions per minute. The ratio of the speeds of the charging devices and of the developing roller preferably lies within the range of from about 1.2:1 to 4:1. The thickness of the layer of developer, which has been mentioned above as being of from about 30 μm, up to about 150 μm, can be obtained using the above-mentioned speeds and voltage values and distances between the developing roller 3 and the recording medium 11. Since the voltage of the developing roller 3 has the same polarity as that of the recording medium 11, but, in terms of absolute value, is lower than the voltage of the latent charge image 14 on the recording medium 11, but higher than the voltage of the points at which no image is present (which are the discharged points on the recording medium 11) it should be apparent that the background of the copies will be substantially free of developer. The degree to which this is the case can be controlled, to a substantial extent, by the magnitude of the voltage which is applied to the developing roller 3.

It will be apparent to the artisan that it is possible to utilize voltages with reversed polarities at the individual elements of the developing apparatus if it is intended that the single component developer used be negatively charged and the recording medium 11 be positively charged. Consequently, it is possible to carry out reverse development.

Referring again to FIG. 1, a resilient scraper 19 is positioned between the developing roller 3 and the first charging device 1 and is fastened to a pivotable transverse profile 6. This scraper bears against the peripheral surface of the developing roller 3, and strips away excess developer 13, which is not attracted by the latent charge image 14, from the peripheral surface of the developing roller 3. The stripped-off developer trickles down onto the bristles of the first charging device 1 and is picked up again by these bristles.

The quantity of single component developer which is present in the circulation is small and, correspondingly, the residence time of the single component developer in the developing apparatus is also very short. The metered replenishment of the single component developer consumed is conventionally effected in accordance with an optical measurement of the blackening on the developing roller 3.

Experiments have shown that the first charging device 1 applies approximately three-quarters of the total quantity of single component developer to the developing roller 3, while the remainder of the developer reaches the developing roller 3 via the second charging device 2.

The velocity at which the single component developer 13 separates from the bristles, and hence the order of magnitude of the tribo-electric charging, is determined by the selection of mechanical variables, such as the diameter and length of the bristles of the charging devices 1 and 2, of the material of the charging devices and of the scrapers 4 and 7, as well as of the speeds at which the charging devices and the developing roller 3 rotate.

Figure 2:
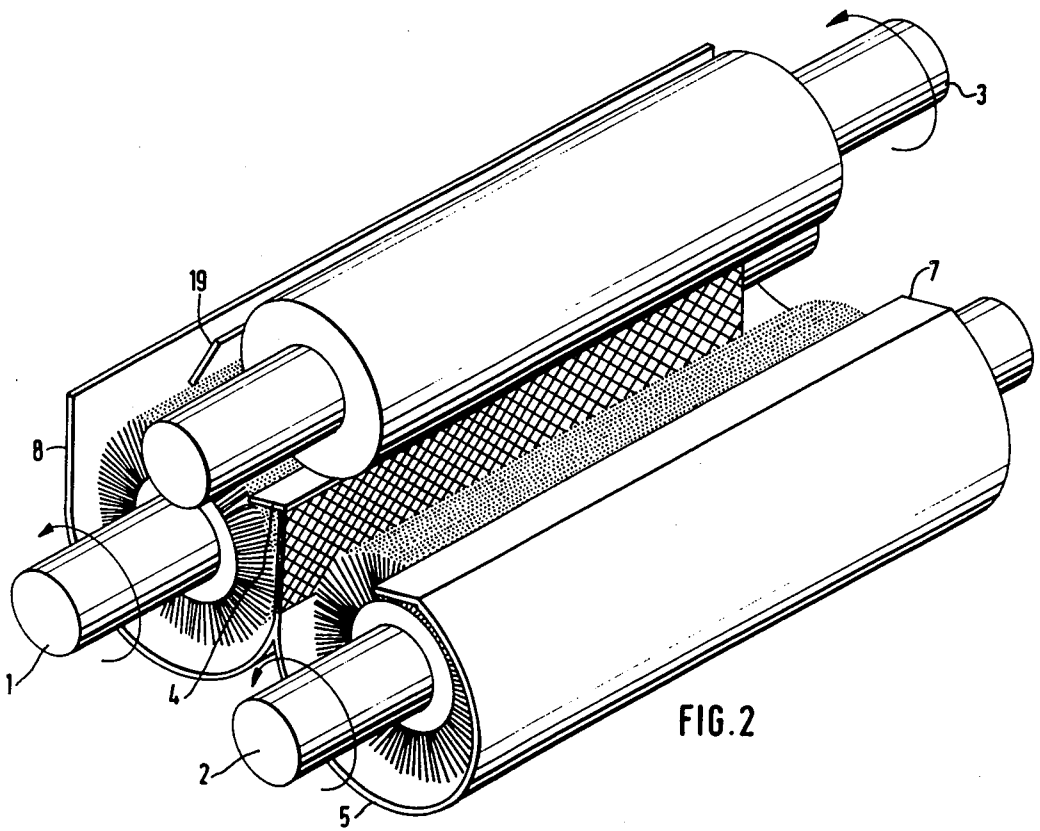
FIG. 2 shows a perspective view of portions of the developing apparatus according to FIG. 1.

For clarity, various parts of the developing apparatus of FIG. 1 are depicted, in perspective, in FIG. 2; the sole difference being that the scraper 7 in FIG. 2 is integrated with the trough 5 so that the scraper 7 does not require its own connection to the voltage source 9.

Figure 3:
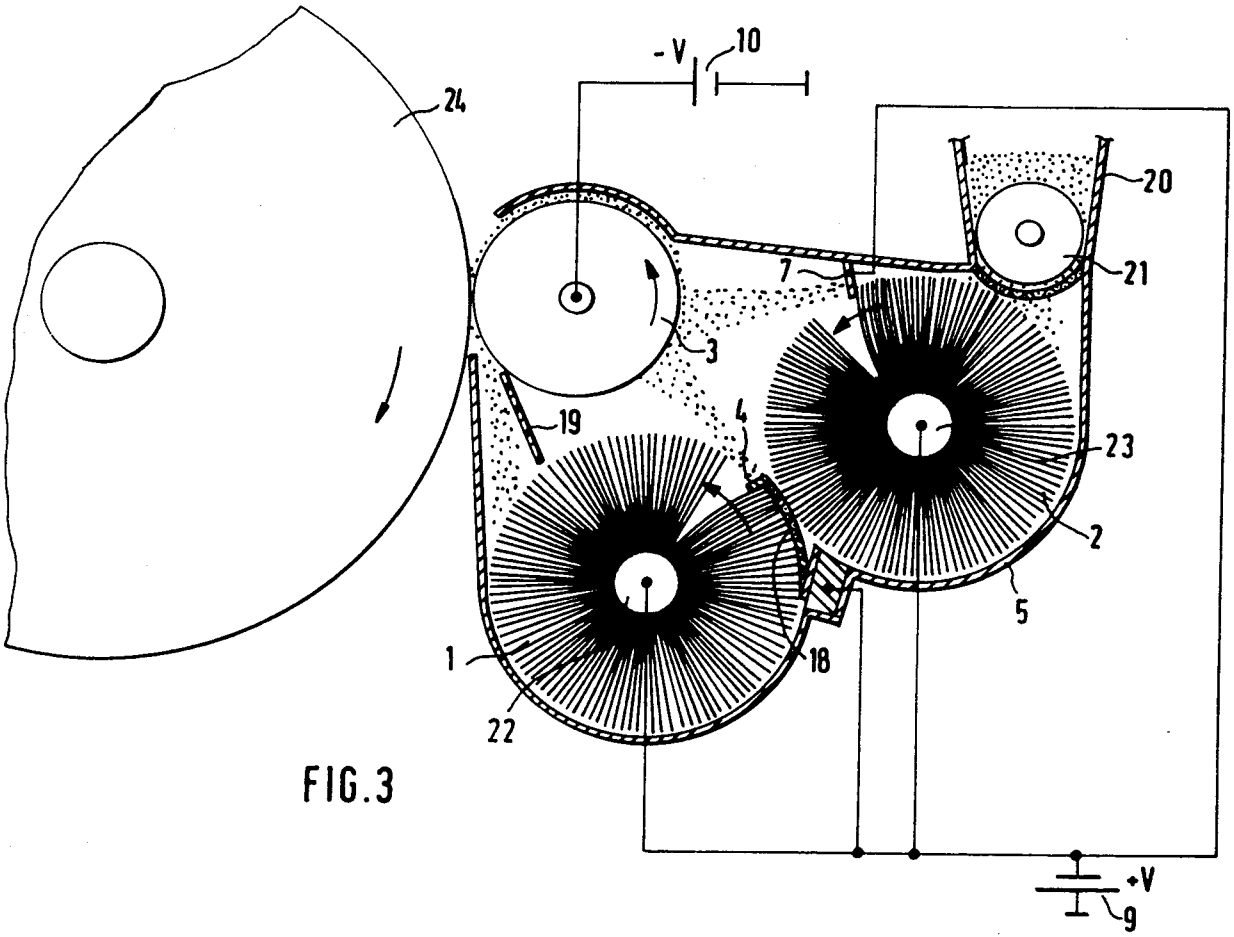
FIG. 3 is a diagrammatic view of an alternate embodiment of the developing apparatus which is similar to the embodiment of FIG. 1.

An alternate embodiment of the developing apparatus is represented, diagrammatically, in FIG. 3. This embodiment is suitable for a recording medium which is stretched over the peripheral surface of a drum 24; a so-called photoconductive drum. As depicted, the developing roller 3 may be located in the three o'clock position with respect to the drum 24; it being understood that other positions such as a nine o'clock position are likewise possible. Two charging devices 1 and 2, which are formed by brushes, are arranged, in an angled manner, below the developing roller 3. In the embodiments according to FIGS. 1 and 3, corresponding parts are marked with matching reference numbers. In the embodiments according to FIGS. 1 to 3, the developer is sprayed onto the surface of the developing roller 3 in essentially a radial direction.

Figure 4:
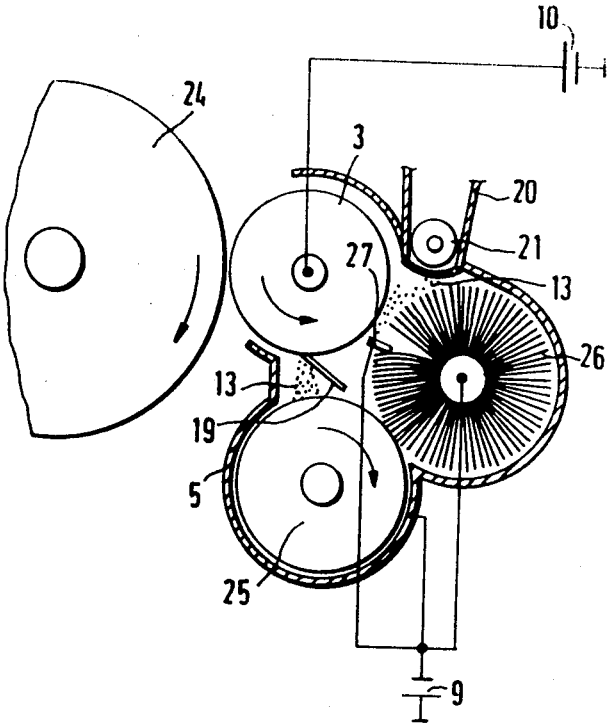
FIG. 4 is a diagrammatic view depicting a further embodiment of the developing apparatus, with a single charging device.

FIG. 4 illustrates a further alternate embodiment of the developing apparatus, which functions by means of a single charging device 26, which is preferably configured as a brush, and in which the application of the developer to the developing roller 3 takes place tangentially. The metal core of the charging device 26 is connected to one of the poles of the voltage source 9, as is a scraper 27 which functions in conjunction with the bristles of the charging device 26. The mode of operation is analogous to that which was described above with reference to FIG. 1. The particles of developer stored on the bristles and between the bristles are, after the bristles contact the scraper 27, thrown onto the peripheral surface of the developing roller 3. The developing roller is connected to one of the poles of a voltage source 10 which has a voltage of opposite polarity to the voltage of the charging device 26. A layer of developer, having a uniform thickness, forms on the peripheral surface of the developing roller 3. Developer from this layer passes over onto the recording medium on the drum 24 in a manner corresponding to the latent charge image present on the recording medium. The remaining developer on the developing roller 3 is removed by a scraper 19 and passes to a collecting roller 25. The developer is brushed off of roller 25 by the bristles of the charging device and is fed to the developing roller anew, the toner charge being restored to the previous level by means of the voltage which is applied.

The foregoing description of the preferred embodiments of the invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed:

1. An apparatus which utilizes an electrically charged single component developer for developing an electrostatic latent image which has been generated on a recording medium, comprising:

a developing roller for conveying a single component developer onto a latent image carried on the recording medium;

charging means for charging said single component developer, said charging means comprising two rotating charging devices, said charging devices being spaced from said developing roller and being separated from one another by a distance which is less than the spacing of either of said charging devices from said developing roller;

a developer feed unit for feeding said single component developer to said charging means; and scraper means associated with said charging means and in glancing contact with a surface of said charging means for imparting an additional charge to said developer and for separating and transferring said charged developer from said charging means to said developing roller, said scraper means comprising a scraper device associated with each of said two charging devices.

2. The apparatus of claim 1, further comprising a second scraper means for stripping excess developer from said developing roller and for returning said excess developer to said charging means.

3. The apparatus of claim 1, wherein the charging devices comprise brushes which are made of an electrically conducting material, and which have cylindrical cores, each of said charging devices being connected to one pole of a voltage source, another pole of which is grounded.

4. The apparatus of claim 3, further including a grid positioned between the charging devices, said single component developer being conveyed from one charging device to another through said grid.

5. The apparatus of claim 4, wherein the grid is composed of an electrically conducting material and is connected to a trough which encloses said charging devices.

6. The apparatus of claim 5, wherein said charging devices have a periphery spaced from said trough and the distance from the trough to the periphery of the charging devices is sufficiently small that no accumulations of the single component developer occur in said space.

7. The apparatus of claim 6, wherein said scraper means, said charging devices, and said trough are connected to a pole of a first voltage source, and wherein said developing roller is connected to a pole of a second voltage source, said poles being of opposite polarity.

8. The apparatus of claim 1, wherein said scraper devices additionally charge said single component developer by tribo-electricity.

9. The apparatus of claim 8, wherein an electrical potential of the same polarity is applied to the charging devices, to the scraper devices, and to a trough which encloses said charging devices.

10. The apparatus of claim 3, wherein the developing roller is connected to a second voltage source and is at a second electrical potential which has a polarity opposite to that of the charging devices, and which, in terms of absolute value, is smaller than the potential of the electrostatic image.

11. An apparatus which utilizes an electrically charged single component developer for developing an electrostatic latent image which has been generated on a recording medium, comprising:

a developing roller for conveying a single component developer onto a latent image carried on the recording medium;

a charging device for charging said single component developer, configured as a brush having bristles;

a developer feed unit for feeding said single component developer to said charging device; and a scraper associated with said charging device and in glancing contact with said bristles of said charging device for imparting an additional charge to said developer and for separating and transferring said charged developer from said charging device to said developing roller.

12. The apparatus of claim 11, wherein a collecting roller is positioned proximate to the developing roller and in contact with the charging device, wherein said collecting roller collects developer which a scraper adjacent said developing roller has stripped from the developing roller, and wherein the bristles of the charging device brush the developer from the collecting roller for transport back to the developing roller.

* * * * *